United States Patent [19]

Fast et al.

[11] Patent Number: 4,965,949

[45] Date of Patent: Oct. 30, 1990

[54] LABEL HOLDER ATTACHMENTS FOR PRODUCT INFORMATION DISPLAY TAGS

[76] Inventors: Jacob Fast; Robert Fast, both of 7561 NW. 9th St., Plantation, Fla. 33317

[21] Appl. No.: 346,698

[22] Filed: May 3, 1989

[51] Int. Cl.[5] ..... G09F 3/00

[52] U.S. Cl. ..... 40/642; 40/651; 40/663; 211/59.1; 248/220.3

[58] Field of Search ..... 248/300, 220.4, 220.3; 211/59.1; 40/642, 662, 663; 649, 651

[56] References Cited

U.S. PATENT DOCUMENTS

| | | | |
|---|---|---|---|
| 1,685,334 | 9/1928 | Myers | 40/663 |
| 4,485,575 | 12/1984 | Fast . | |
| 4,525,944 | 7/1985 | Fast . | |
| 4,583,308 | 4/1986 | Taub | 248/220.4 X |
| 4,646,454 | 3/1987 | Fast . | |
| 4,665,639 | 5/1987 | Fast . | |
| 4,693,024 | 9/1987 | Fast . | |
| 4,698,929 | 10/1987 | Fast . | |
| 4,703,570 | 11/1987 | Fast . | |
| 4,713,899 | 12/1987 | Fast | 40/642 |
| 4,715,135 | 12/1987 | Fast . | |

FOREIGN PATENT DOCUMENTS

| | | | |
|---|---|---|---|
| 7493 | 5/1981 | United Kingdom | 40/642 |

*Primary Examiner*—David L. Talbott

*Attorney, Agent, or Firm*—Fleit, Jacobson, Cohn, Price, Holman & Stern

[57] ABSTRACT

A label holder attachment is provided for the distal end of an elongate product information display tag of the kind that extends over a horizontally disposed product support hook. The label holder attachment may be used, for example, to provide temporary product information such as sale or special offer pricing. The label holder attachment has a pair of fold-down tabs which can be squeezed together and inserted through an elongate slot at the distal end of the tag in order to mount the attachment on the tag. The attachment also has a label holding portion which extends forwardly of the tag and which can take a number of different forms.

16 Claims, 2 Drawing Sheets

FIG. 1
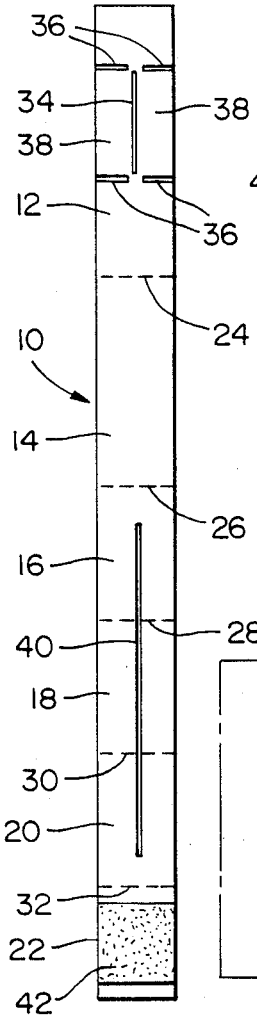
FIG. 2
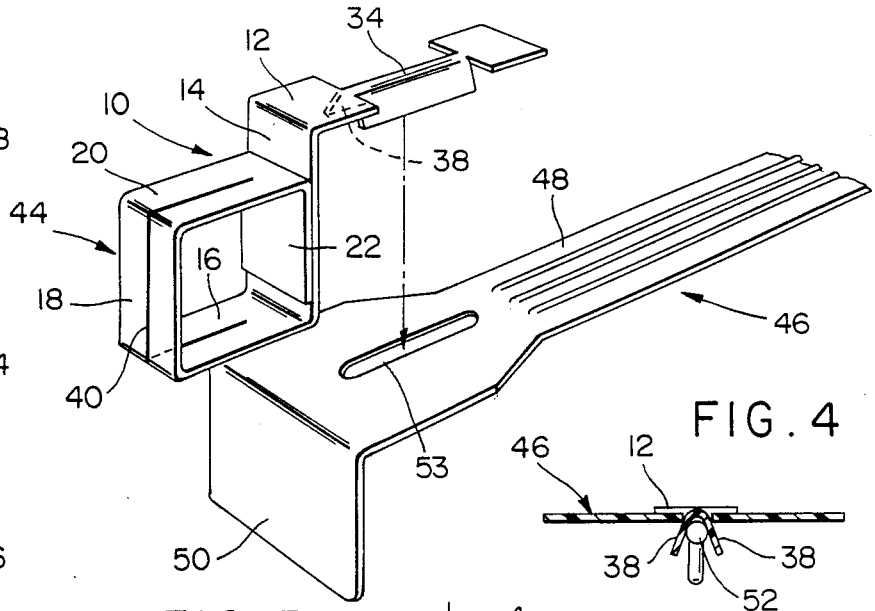
FIG. 4
FIG. 3
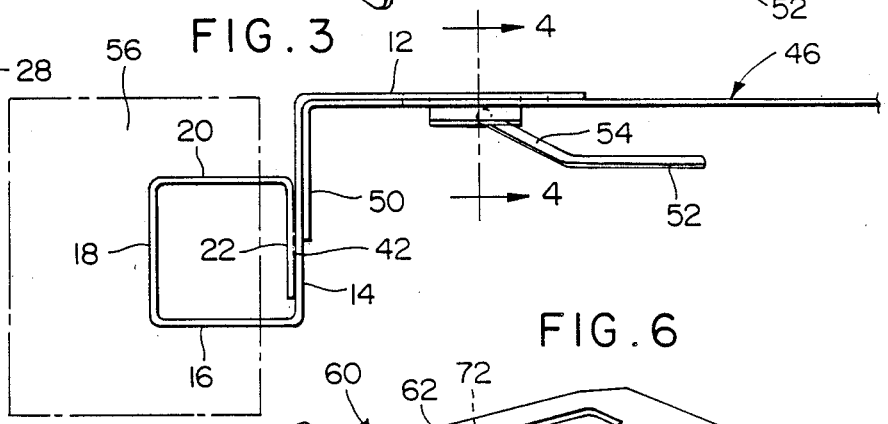
FIG. 5
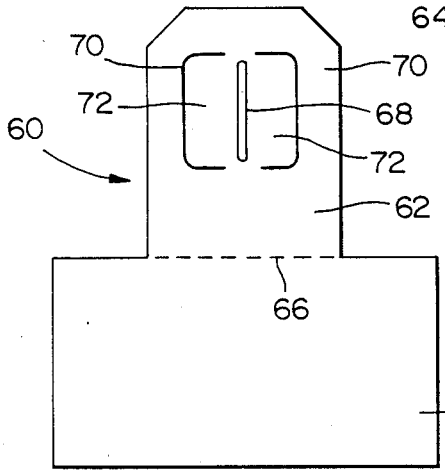
FIG. 6
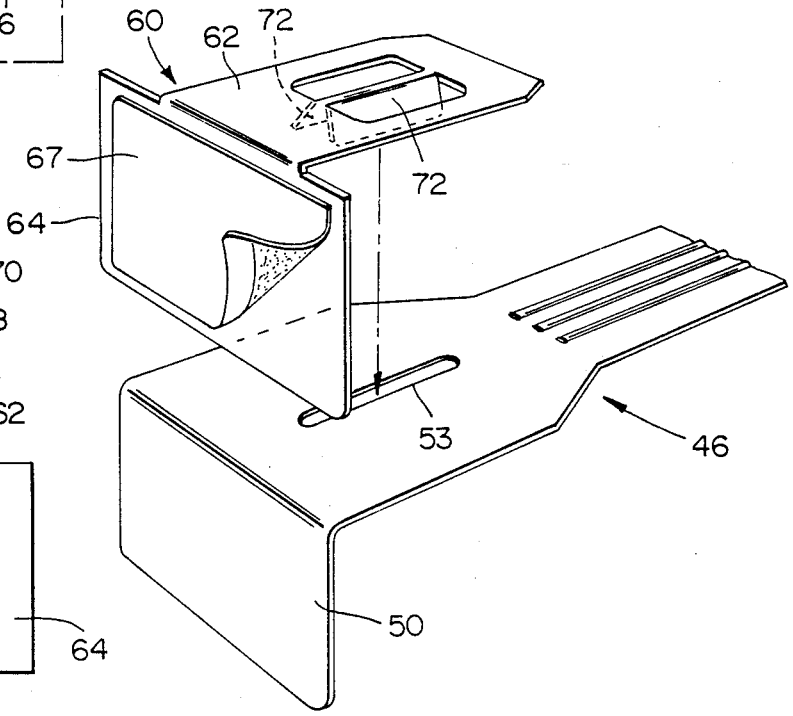

LABEL HOLDER ATTACHMENTS FOR PRODUCT INFORMATION DISPLAY TAGS

BACKGROUND OF THE INVENTION

This invention relates to label holder attachments for product information display tags of the type which are used in conjunction with horizontally extending elongate product support hooks, for presenting product information at a forward or distal end of a hook.

Product information display tags of the above type, are now quite well known, such tags commonly being die-cut from plastic sheet material and comprising a proximal end mounting portion for attaching the tag at the proximal end of a hook where, for example, the hook may be mounted on a perforated board or the like, an elongate body portion for extending lengthwise over the hook and a distal end display portion for presenting product information, for example, by way of a label or the like at a distal end of the hook. Generally, such tags may be used in supermarkets, drug stores and the like in conjunction with elongate wire hooks from which rows of products such as blisterpacks are suspended. Also, it is known in such tags, to provide an elongate slot toward the distal end of the body portion for the distal end of the hook to project upwardly through so as generally to center and stabilize the tag.

Examples of elongate product information display tags of the above type may be seen, for example, in my earlier U.S. Pat. Nos. 4,525,944; 4,646,454; 4,665,639; 4,693,024; 4,698,929; 4,703,570, and 4,715,135.

Considering now the practical use of such tags, an occurrence which frequently occurs in a supermarket or drug store environment is the need for specialized, commonly temporary labeling of particular products in a manner which will vividly attract a customer's attention, such labeling, for example, indicating that the particular products may be on sale or special offer. It is an object of the present invention, therefore, to provide a label holder attachment which can be used in conjunction with elongate product information display tag of the above described type for the presentation of required information at the distal end of the tag, such label holder being of a form which can be readily attached to and detached from the tag itself preferably without interfering with permanent labeling already present on the tag.

SUMMARY OF THE INVENTION

The invention provides a variety of designs of label holder attachments for selected mounting at the distal end of product information display tags of the type previously referred to. Each of the label holders attachments utilizes a particularly convenient means for releasably securing same at the distal end of the tag, notably a pair of fold-down longitudinally extending tabs for insertion in the aforementioned slot which is provided in the distal end portion of the tag for the distal end of the hook to project upwardly through. The fold-down tabs are provided on a mounting panel portion of the label holder attachment and are configured to be folded down on opposite sides of a common longitudinal fold line. In use, the tabs may be squeezed together laterally for insertion in the slot and after insertion the tabs spread apart resiliently to preclude their inadvertent removal from the slot. In practice, the tabs when inserted, adopt the form of an inverted V and sit atop the distal end of the hook.

The mounting panel portion of the label holder attachment is dimensioned to extend to the distal end of the tag where it is connected to a label holder portion of the attachment. The label holder portion itself may take various forms, for example, it may comprise a box-like structure with a slit for receiving a label oriented substantially sideways on to the hook and products. Alternatively, the label holder panel may be a plane fold-down panel which extends over an already present label holder panel of the tag itself. In a further alternative, the label holder portion may comprise a pair of panels which fold down on opposite sides of a longitudinal fold line to provide an inverted V formation on which labels can be placed so to be viewed from a side-on position with respect to the length of the hook and tag.

The fold-down tabs for mounting the label holder attachment may extend from opposite sides of the mounting portion or, for greater strength and stability the mounting portion may comprise a relatively wide panel with the tabs being cut out from the body of the panel.

Additional features and advantages of the invention will be apparent from the ensuing description and claims read in conjunction with the accompanying drawings.

BRIEF DESCRIPTION OF THE DRAWINGS

FIG. 1 is a face view of a blank for folding into a first embodiment label holder attachment according to the invention.

FIG. 2 is a perspective view of the first embodiment label holder attachment showing the manner of mounting same on a product information display tag.

FIG. 3 is a side elevational view showing the attachment mounted on the tag.

FIG. 4 is a sectional view on line 4—4 of FIG. 3.

FIG. 5 is a face view of a blank for forming a second embodiment label holder attachment according to the invention.

FIG. 6 is a perspective view of the second embodiment label holder attachment showing the manner of mounting same on a tag.

DESCRIPTION OF PREFERRED EMBODIMENTS

Figure 7:
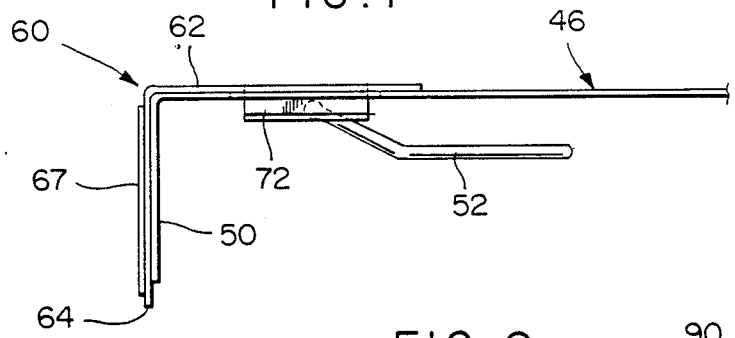
FIG. 7 is a side elevational view of the second embodiment attachment mounted on the tag.

Referring initially to FIG. 1, there is shown a blank 10 for folding into a label holder attachment as will be described. In the form illustrated, the blank 10 is a relatively long narrow strip of plastic sheet which may, for example, be die cut and stamped to provide a plurality of panels 12–22 separated by respective transverse fold lines 24–32. Panel 12 has a central longitudinally extending fold line 34 and transverse slits or cuts 36 extending from opposite edges of the panel so as to define a pair of tabs 38 which can fold down about the common fold line 34. A lengthwise slit 40 is provided along the entire length of panel 18 and extends across fold lines 28, 30 along substantial lengths of the respective panels 16 and 20. One surface of panel 22 is provided with an area of contact adhesive 42 which may, in use, be covered with release paper, not shown.

In use, the blank 10 can be folded into the configuration shown in FIGS. 2 and 3 wherein panel 14 is folded substantially at right angles to panel 12 and panels 16, 18, 20, and 22 are themselves folded at right angles to form a box-like structure 44 which forms a label holder portion of the attachment. The contact adhesive 42 is used to adhere panel 22 to panel 14. Panel 12 forms a mounting portion of the label holder attachment.

The label holder attachment 10 in the folded configuration shown in FIG. 2 is intended for use in conjunction with an elongate product information display tag of the kind referred to in the above noted patents. One example of such a tag is shown in FIGS. 2 through 4 and generally indicated by reference 46 in the drawings. Only a forward or distal end section of tag 46 is shown including the forward portion of a main body part 48 of the tag and a fold-down information display portion 50 at the distal end of the tag. It will be appreciated that tag 46 also includes a proximal end mounting portion for securing same to an elongate product support hook 52, such mounting portion not being shown in the drawings. It is also evident that the tag 46 includes an elongate slot 53 at the distal end of body portion 48, such slot normally being intended for the distal end 54 of hook 52 to extend upwardly through.

In the present invention, however, slot 53 is used as a convenient means for securing the label holder attachment 10. To this end, the length of the tabs 38 are made substantially to conform to the length of slot 53. Thus, in use, the tabs 38 can be squeezed together and inserted through the slot 53 from above. When released, the tabs will resiliently spring apart to form an inverted V as shown in FIG. 4 precluding inadvertent removal of the holder attachment from the tag 46. Also, as evident in figure 4, the inverted V will rest atop the forward end of hook 52. It is further evident that the length of panel 12 is made such that panel 14 will align substantially with the forward end of tag 46.

When secured to tag 46 as shown, for example in FIG. 3, slit 40 is available for receipt, for example, of a label or sign 56 which is thereby resiliently and frictionally gripped in the label holder portion of the attachment in a manner, for example, providing prominent labeling for products suspended from hook 52 in a side-on orientation, for example so that will be vividly apparent to customers walking down a supermarket aisle or the like. It will be equally evident that label holder attachment 10 can, when required, be readily removed from tag 46 by squeezing the tabs 38 back through the slot 53. Then, the labeling originally contained on display portion 50 will again be fully apparent. The form of label holder attachment shown in FIGS. 1 through 4 is similar to that which is disclosed in my co-pending patent application Ser. No. 07/224,822, filed July 27, 1988 and titled "Sign Holder with Shelf Attachment". The contents of the co-pending application are expressionally cooperated herein by reference.

FIGS. 5 through 7 show a second embodiment label holder attachment 60, of somewhat simplified form, comprising a mounting portion in the form of a plane panel 62 and a fold-down label holder portion in the form of a second plane panel 64. A transverse fold line 66 separates the respective panels and it will be evident that panel 64 is somewhat wider than panel 62. Further, panel 62 has a longitudinal fold line 68 and oppositely directed channel-shaped slits or cuts 70 defining opposed fold-down tabs 72 equivalent to the tabs 38 of the first embodiment. It will be evident that attachment 60 may be mounted on the product information display tag 46 in similar manner to the first embodiment structure with the tabs 72 being squeezed together and inserted through slot 53 in like manner to that previously described. The tabs are again dimensioned to conform substantially with the length of slot 53 and panel 62 is again dimensioned so that panel 64 extends down the front of display portion 50 for receiving, for example, a secondary label 67. It will also be evident that panel 62 is considerably wider than the equivalent panel 12 of the first embodiment so that the tabs 72 can be in form of cut outs rather than extending from the edges of the panel as in the first embodiment. The second embodiment structure is somewhat more stable and more resistant to tearing at the ends of the tabs than is the first embodiment structure. The second embodiment structure may be used, for example, where it is desirable entirely to obsure the initial labeling used on portion 50 of the tag 46. Otherwise, it will be evident that the second embodiment structure may be attached and detached to tag 46 in the same manner as the first embodiment structure.

Figure 9:
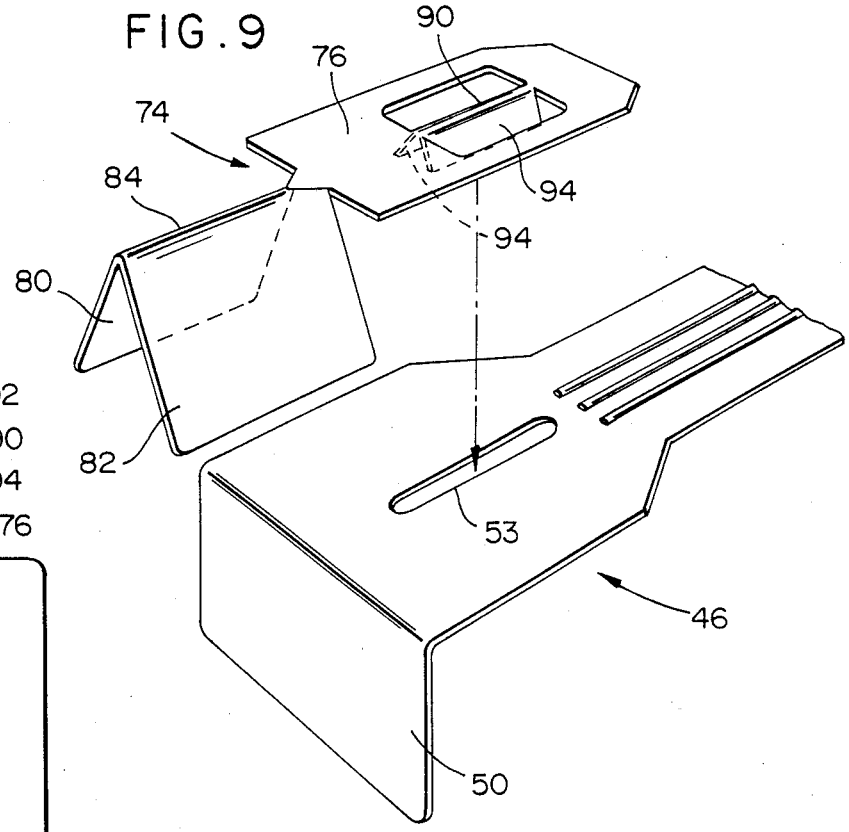
FIG. 9 is a perspective view of the third embodiment attachment showing the manner of mounting same on a tag.
Figure 8:
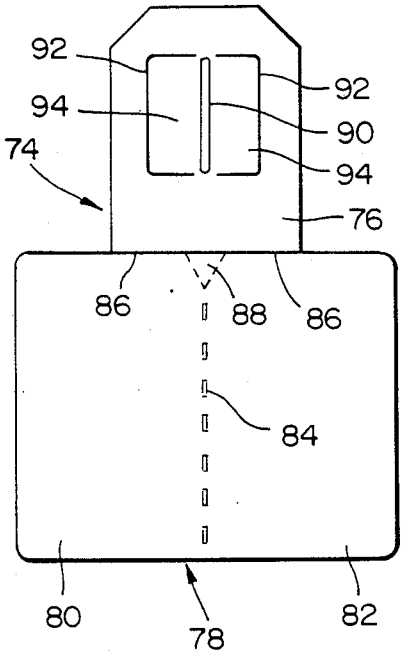
FIG. 8 is a face view of a blank for forming a third embodiment label holder attachment according to the invention.
Figure 10:
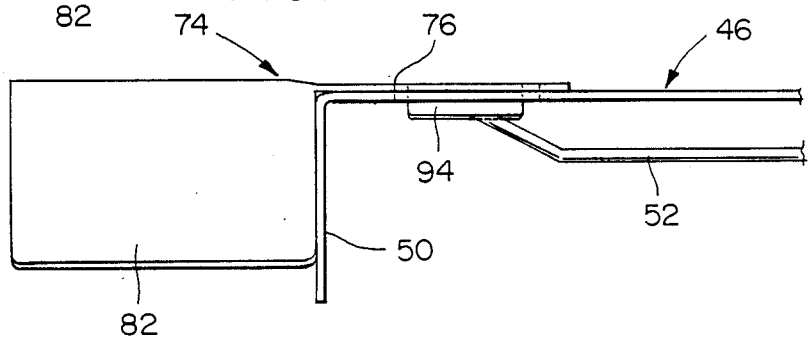
FIG. 10 is a side elevational view of the third embodiment attachment mounted on the tag.

Referring now to FIGS. 8 through 10, there is shown a third embodiment label holder attachment 74 having a mounting portion in the form of a first planar panel 76 and a label holder portion 7 which comprises a pair of panels 80, 82 which can be folded about the longitudinal fold line 84. In this case, the label holder portion 78 and the mounting portion 76 are separated by transverse cuts 86 which define a central triangular portion 88 therebetween that holds the two portions of the attachments together. The mounting panel 76 again has a central fold line 90, channel-shaped cuts 92 and fold-down tabs 94 all of which correspond to the equivalent structures 68, 70, and 72 of the second embodiment attachment.

It will be understood that the third embodiment attachment can be mounted on tag 46 in precisely the same manner as the previous embodiments by squeezing the tabs 72 together and inserting same through slot 53. In the third embodiment structure, the panels 80, 82 may be folded about fold line 84 into the configuration substantially of an inverted V as shown in FIG. 9. Thus, when in use, the respective panels 80, 82 can be used to provide labeling for viewing in a side-on orientation for example, for customers walking along a supermarket aisle. In this arrangement, however, the original labeling which may be provided on display portion 50 may also be viewed through the space between the panels 80, 82.

In all the embodiments illustrated, the tag 46 has been shown 14 to have an integral display portion 50. It is also possible, however, to utilize the present invention with tags having removable display portions in place of the integral display portion 50. The above noted patents show examples of such alternative tag structures.

While only preferred embodiments of the invention have been described herein in detail, the invention is not limited thereby and modifications can be made within the scope of the attached claims.

What we claim is:

1. A label holder attachment for use with an elongate product information display tag of the kind having a proximal end mounting portion for securing the tag at the proximal end of a generally horizontally extending product support hook, an elongate body portion for extending over the length of the hook to present product information at a distal end thereof, and an elongate slot formed toward the distal end of the body portion, the label holder attachment comprising a mounting portion and a label holder portion, the mounting portion including a substantially planar mounting panel with a longitudinal fold line and pairs of laterally outwardly extending cuts at opposite ends of the longitudinal fold line defining a pair of fold-down tabs extending in opposite directions from the longitudinal fold line, the tabs when squeezed together being insertable in said slot from above to mount the attachment on the tag, the mounting panel being dimensioned to locate the label holder portion at the distal end of said body portion and the label holder portion including means for attaching a label thereto.

2. The invention as defined in claim 1 wherein said cuts extend from opposite longitudinal edges of the mounting panel.

3. The invention as defined in claim 1 wherein said tabs are defined by cutouts in the body of the mounting panel.

4. The invention as defined in claim 1 wherein the label holder portion comprises a strip of material for forming into a closed loop, and a lengthwise slit in said strip for receiving a label to be viewed sideways on with respect to the tag.

5. The invention as defined in claim 4 wherein said strip has plural panels separated by transverse fold lines for folding the strip into a closed loop of rectangular form.

6. The invention as defined in claim 5 including adhesive means for securing terminal panels of said strip together when forming the loop.

7. The invention as defined in claim 1 wherein the label holder portion comprises a fold-down label panel separated from the mounting panel by a transverse fold line.

8. The invention as defined in claim 1 wherein the label holder portion is separated form the mounting panel by opposite transverse slits extending from opposite sides of the mounting panel, said slits defining a central transverse fold section therebetween for enabling the holder portion to be folded down from the mounting panel, and wherein the holder portion comprises a longitudinal fold line defining opposite panels which can be folded down from said fold line substantially into a configuration of an inverted V to provide label holding surfaces aligned sideways on with respect to the tag.

9. In combination, a label holder attachment and an elongate product information display tag of the kind having a proximal end mounting portion for securing the tag at the proximal end of a generally horizontal extending product support hook, an elongate body portion for extending over the length of the hook to present product information at a distal end thereof, and an elongate slot formed toward the distal end of the body portion, the label holder attachment comprising a mounting portion and a label holder portion, the mounting portion including a substantially planar mounting panel with a longitudinal fold line and pairs of laterally outwardly extending cuts at opposite ends of the fold line defining a pair of fold-down tabs extending in opposite directions from the fold line, the tabs being inserted through said slot from above thereby mounting the attachment on the tag, the mounting panel being dimensioned to locate the label holder portion at the distal end of said body portion, and the label holder portion including means for attaching a label thereto.

10. The invention as defined in claim 9 wherein said cuts extend from opposite longitudinal edges of the mounting panel.

11. The invention as defined in claim 9 wherein said tabs are defined by cutouts in the body of the mounting panel.

12. The invention as defined in claim 9 wherein the label holder portion comprises a strip of material formed into a closed loop and a lengthwise slit in said loop for receiving a label to be viewed sideways on with respect to the tag.

13. The invention as defined in claim 9 wherein the label holder portion comprises a fold-down label panel separated from the mounting panel by a transverse fold line.

14. The invention as defined in claim 9 wherein the label holder portion is separated from the mounting panel by opposite transverse slits extending from opposite sides of the mounting panel, said slits defining a central transverse fold section therebetween for enabling the holder portion to be folded down from the mounting panel, and wherein the holder portion comprises a longitudinal fold line defining opposite panels which can be folded down from said fold line substantially into a configuration of an inverted V to provide label holding surfaces aligned sideways on with respect to the tag.

15. In combination, a generally horizontally extending product support hook, an elongate product information display tag having a proximal end mounting portion securing the tag at a proximal end of the hook, the tag further having a elongate body portion extending over the length of the hook to present product information at a distal end thereof and an elongate slot formed towards a distal end of the body portion, the combination further including a label holder attachment comprising a mounting portion and a label holder portion, the mounting portion including a substantially planar mounting panel with a pair of fold-down tabs extending in opposite directions from a common longitudinal fold line, the tabs being inserted through said slot from above thereby mounting the attachment on the tag with a part of the hook being received between the tabs, the mounting panel being dimensioned to locate the label holder portion at the distal end of the body portion, and the label holder portion including means for attaching a label thereto.

16. The invention as defined in claim 15, wherein the label holder portion of the attachment is folded down from the mounting portion.

* * * * *